US005231765A

United States Patent [19]

Sherman

[11] Patent Number: 5,231,765

[45] Date of Patent: Aug. 3, 1993

[54] ILLUMINATED SIGHT HAVING A LIGHT COLLECTOR SERVING A FIBER OPTIC

[76] Inventor: James R. Sherman, 710B Linden Ave., Lewiston, Id. 83501

[21] Appl. No.: 904,943

[22] Filed: Jun. 26, 1992

[51] Int. Cl.[5] ..... F41G 1/467

[52] U.S. Cl. ..... 33/241; 33/265

[58] Field of Search ..... 33/241, 265; 124/87

[56] References Cited

U.S. PATENT DOCUMENTS

| | | | |
|---|---|---|---|
| 3,121,163 | 2/1964 | Rickert | 33/241 |
| 3,320,671 | 5/1967 | Rickert et al. | 33/241 |
| 3,945,127 | 3/1976 | Spencer | 33/265 |
| 4,030,203 | 6/1977 | Ackerman, Jr. | 33/241 |
| 4,070,763 | 1/1978 | Carts, Jr. | 33/241 |
| 4,177,572 | 12/1979 | Hindes | 33/241 |
| 4,928,394 | 5/1990 | Sherman | 33/265 |
| 5,086,567 | 2/1992 | Tutsch | 33/241 |
| 5,090,805 | 2/1992 | Stawarz | 33/241 |

*Primary Examiner*—Thomas B. Will
*Attorney, Agent, or Firm*—James D. Givnan, Jr.

[57] ABSTRACT

A sight for attachment to an archery bow and including a base having parallel guides along which sight pins may be vertically adjusted. A series of fiber optics extend one each through the sight pins and terminate therein to provide an illuminated bead. The opposite ends of the fiber optics are each in light receiving relationship with a collector and conductor member in place on the sight base. The light collector and conductor members are formed of a polymer with fluorescent material and have a relatively large light collecting surface area and a small light emitting edge area which emits light to the ends of the fiber optics. The light collector and conductor members may include curved segments as well as tapered segments to provide a suitable ratio of light collecting surface area to light emitting edge area to assure brightly illuminated sight pins. An interface between the light collector and conductor members may include bores formed within the light collector and conducting members into which the fiber optic ends are insertably seated.

6 Claims, 1 Drawing Sheet

ILLUMINATED SIGHT HAVING A LIGHT COLLECTOR SERVING A FIBER OPTIC

BACKGROUND OF THE INVENTION

The present invention pertains generally to sights for use on archery bows as well as other types of weapons.

U.S. Pat. No. 4,928,394 issued to the present inventor, discloses a sight usable on archery bows and having fiber optics for conducting ambient light to sight pins. The light receiving ends of the fiber optics are exposed above the sight for optimum collection of ambient light. While such as arrangement constitutes an advance in sight art, there are some instances when even greater illumination of a sight bead is desirable.

As the present class of sights are often used in hunting, a problem exists in that an ambient light collector and conductor component must not be of a size where it would hinder bow use in the field. For example, sights with fragile, projecting components are susceptible to being damaged upon contact with trees, bushes, undergrowth, etc.,. Where several illuminated sight beads are desired in a sight a problem is encountered in collecting adequate light from ambient light.

The use of artificial light such as a battery powered bulb is now prohibited by the game laws of many states.

The sight disclosed in the above noted patent provided a multitude of fiber optic ends, offset above a sight body, and were directional i.e., required orientation toward a source of light.

SUMMARY OF THE PRESENT INVENTION

The present invention is embodied in the provision of light collecting and conductor means for unobstrusive installation on a sight body for maximum light collection for transfer to light transmission means such as a fiber optic. The light collecting and conductor member is referred to hereinafter as a collector.

A sight is disclosed and includes a platform or support member on which one or more collectors may be disposed. Provision is made for retention of a fiber optic end in proximity of the collector to receive light emitted from an edge of the collector. Accordingly for the transfer of light to a fiber optic an interface is provided. The collector may be provided for retention of the optic end. Where two or more collectors are used it may be desirable that the fiber optic be selectively coupled in a detachable manner. Accordingly the sight beads embodied in the remaining ends of the fiber optics may be color coded with each color signifying a bead for use on a target of a certain range.

Provision is made for the installation of a collector or collectors on a support of the present sight using lugs which engage openings in the support to minimize collector edge surface through which light is undesirably emitted. Minimizing of light emitting edges results in a high proportion of the light collected being emitted toward a bright fiber optic end.

Advantages of the system include the sight pins being brighter. The light collectors can be any size because they are not in the sight "picture." Being remote from the sight pins allows relatively large light collectors conducted by fiber optics to a small aiming point.

The collector material converts ultraviolet light into visible light so brightness is enhanced, especially before sunrise, after sunset, and in heavy cover, because there is a higher ratio of ultraviolet light during these conditions. Such times are also the best times and places to hunt. The light collectors gather ambient light, rather than only sky light to render the pins bright under most all conditions.

The sight pins can be of different colors by the use of different colored light collectors to help the archer to distinguish between the sight pins for targets at different yardages. Also some people can see some colors better than others and some colors show up better in different conditions, i.e., snow, heavy cover, fall colors, etc., hence the convenient changing of light collectors permits adapting the sight the user's desires.

Some specific features in the design of the light collectors include their continuous nature to provide a high surface-to-edge area ratio. Also the collectors are preferably tapered as when serving one fiber optic to retain a high surface-to-edge area ratio.

Important objectives include the provision of a sight with a light collector of compact design yet having a sizeable surface area permitting collector installation on a sight to provide a bright fiber optic end, constituting a bright bead, even though only a low amount of ambient light is present; the provision of a sight wherein one or more collectors receive light transmitting members, such as fiber optics, in a detachable manner permitting selective attachment to one of multiple collectors; the provision of a collector having mounting lugs for biased, snap on engagement with a support to permit removal without specific tools.

DETAILED DESCRIPTION OF THE PREFERRED EMBODIMENTS

Figure 1:
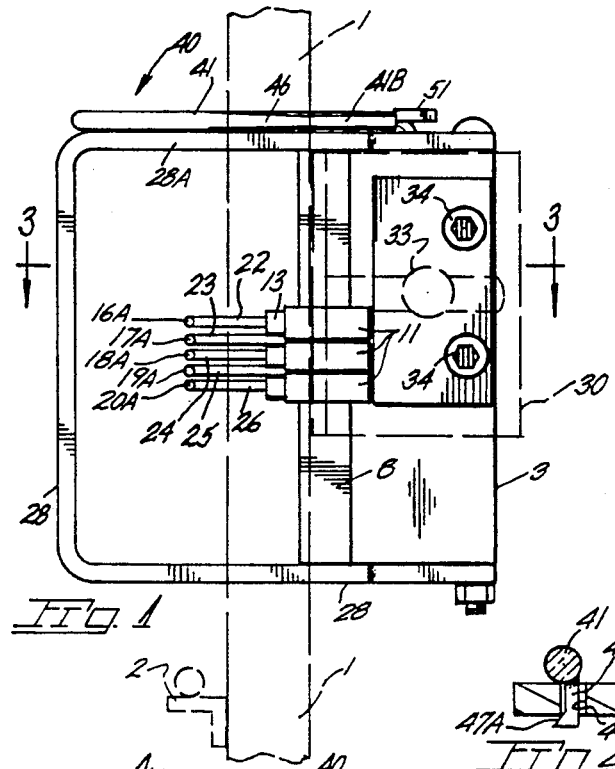
FIG. 1 is a rear elevational view of the sight as viewed by an archer during use.

With continuing attention to the drawings wherein applied reference numerals indicate parts similarly hereinafter identified, reference numeral 1 indicates the riser of an archery bow which is that portion of a bow immediately above the bow hand grip (not shown). An arrow rest is indicated at 2. The description of the sight hardware may be brief as it is very similar to that disclosed in U.S. Pat. No. 4,928,394.

A base of the present sight is indicated at 3 and defines an internal open area 4 by means of a base end wall 5 and side wall 6. Upright guides at 7 and 8 on each side wall of the base define upright slots at *7a–8a*.

Adjustably disposed on each guide are sight pin carriers at 10 and 11 respectively, with each carrier internally shaped so as to correspond closely to a cross sectional shape of the guide to permit slidable movement of the pin carrier along its guide. Each pin carrier is provided with a clamping screw at 12–13 to urge the C-shape pin carrier into gripping engagement with its guide.

Figure 3:
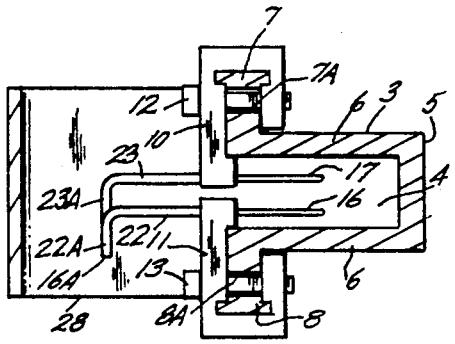
FIG. 3 is a horizontal sectional view taken downwardly along line 3—3 of FIG. 1.

Illuminated beads are at 16A, 17A, 18A, 19A and 20A each being the light emitting end of a flexible fiber optic at 16–20. Sight pins at 22–26 are tubular and each serve to carry a fiber optic end segment with the optic end or face emitting light a: cons a bead of the sight. The sight pins are of right angular shape with end portions at 22a–23a (FIG. 3) which are of lengths to locate the fiber optic end or beads in a common vertical plane. The light transmitting fiber optics 16-20 extend from their respective sight pins into open area 4 of the base where they may flex somewhat during sight pin adjustment along base guides 7 and 8. Affixed to base 3 is a guard 28 which additionally serves, at its uppermost end, as a support or platform at 28A for the later described light collecting and conducting members hereinafter referred to as collectors.

For purposes of sight installation on the bow a mounting plate 30 is provided having one flange adapted for securement to the riser 1 while a remaining flange is secured by a fastener 33 to a mounting block 32 which in turn is secured to base 3 by countersunk fasteners 34.

Figure 5:
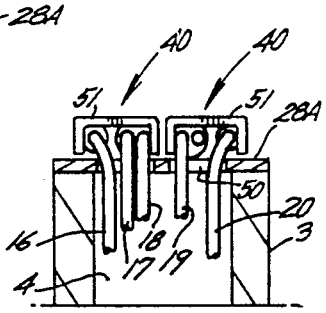
FIG. 5 is a vertical sectional view taken along line 5—5 of FIG. 2.
Figure 6:
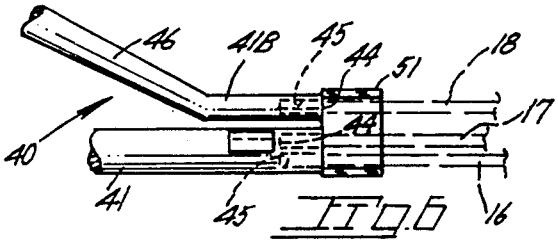
FIG. 6 is an enlarged fragmentary bottom plan view of a collector and conductor member.

With attention now to the light collecting and conductor means, termed collectors, the same are indicated generally at 40 shown in place on support 28A of the sight. A collector 40 is of light collecting plastic or a polymer such as that type of material sold under the registered trademark LISA of Bayer AG. The collector material includes a fluorescent dyestuff which converts the absorbed light into a visible wavelength. Conduction of the absorbed light results from the extreme clarity of the transparent plastics and the fluorescence of the dyestuffs used, which are evenly distributed throughout each plastic part. Fluorescence is governed by the laws of geometric optics concerning light refraction and total internal reflection when light passes from a medium of higher optical density in the present instance the polymer to one of lower optical density air. These laws determine that only a small proportion of the fluorescent light is emitted at the interface between the collector and the air with a major portion reflected back into the material and is transmitted through the polymer until it comes to an interface through which it can emerge. Such interfaces are the perimeter edges or other deliberately created "edges" on the plastic to which the collected light can be conducted. For promoting internal reflection it has been found beneficial to provide a collector having minimal light emitting edges, i.e., edges along which internal reflection is not possible. Toward such an objective straight and curved collector segments are provided at 41 and 42. As typically seen in FIGS. 5 and 6, the fiber optics 16–20 terminate in light receiving engagement with light emitting edges of the collectors 40. A suitable light transmitting connection of a collector and fiber optic may be provided by a socket or recess 45 being formed in the end of the collector to permit endwise insertion of an end segment of a fiber optic. Accordingly the inner wall of the recess receives the fiber optic in a friction tight fit but yet a fit permitting manual fiber optic removal and reinsertion in a second collector also provided with such a socket arrangement. Where only one fiber optic is attached to the collector the surface area 44 of the collector light emitting edge may be reduced and hence it has been found desirable to taper at 46 a portion of the collector to avoid excess, light emitting surface area on the collector. Surface area 44 is the end wall of each recess 45.

A preferred form of a collector is of a continuous configuration so as to provide a surface area of maximum size while limiting light emitting edges to a minimum. Accordingly, emergent light emitted at the collector edges is bright resulting in the fiber optic end, proximate one of said edges, receiving a significant portion of the light collected. By using a collector of continuous shape with multiple runs, as opposed to a single run, the surface-to-edge ratio of the collector is approximately doubled resulting in a like increase in the brightness of the fiber optic end or bead.

Attachment of a fiber optic end to a collector may be as earlier noted by the insertion of the optic end segment into a socket formed in the collector end. The socket may be of diameter and depth as to permit suitable frictional engagement or coupling of the fiber optic end by, in effect, the "plugging" of same into the collector. Where multiple collectors are used on a sight the same may be of different colors to permit the beads being of different colors for aiming at targets at different ranges.

Figure 4:
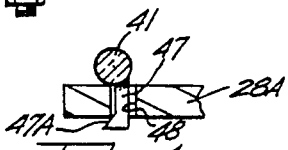
FIG. 4 is a vertical sectional view taken along line 4—4 of FIG. 2.
Figure 2:
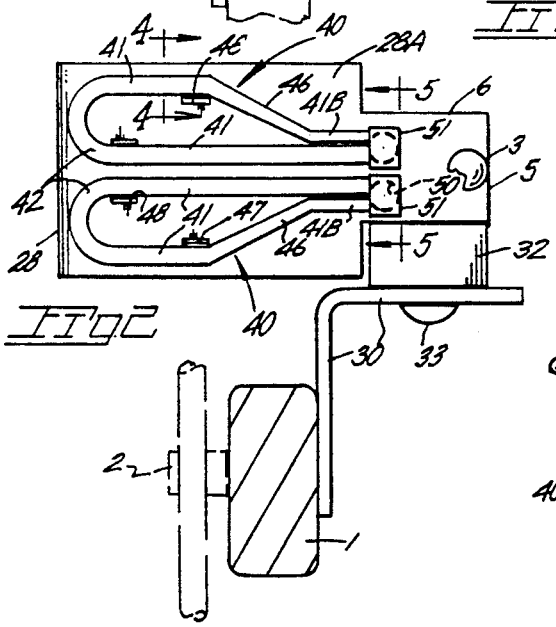
FIG. 2 is a top plan view of FIG. 1.

For attachment of the collectors to the sight I provide lugs at 47 (FIG. 4) integral with the collector segments 41 which project downwardly through openings 48 in the sight platform 28A. The lugs are provided with beveled surfaces at 47A which seat against an edge of opening 48 to retain the collector in place until the lugs are biased out of edge engagement which permits upward removal of the lug and the collector from the platform surface. The platform 28A defines openings as at 50 for the passage of the fiber optics 16–20 into internal area 4 of the base. Plates at 51 interconnect the adjacent ends of the collector segments 41 and 41B.

With the present configuration, each collector 40 has a light collecting outer surface area to light emitting edge surface ratio on the order of 150:1 for optimum bead illumination.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A sight for the sighting of an article to be aimed at a target and including, a base attachable to the article, a sight pin on said base, a fiber optic having a first end segment terminating in a bead carried by said sight pin, a light collector and conductor member in place on said base and having a light collecting surface area to light emitting edge area ratio exceeding 100:1, said member having straight and curved segments and at least one of said segments having a light emitting surface, and said fiber optic having a second end segment disposed so as to receive light emitted by said light emitting surface for illuminating said bead.

2. The sight claimed in claim 1 wherein said collector and conductor member is of an elongate continuous shape.

3. The sight claimed in claim 2 wherein said collector and conductor member is of non-constant cross-section.

4. The sight claimed in claim 2 wherein said collector and conductor member includes a tapered segment to reduce the area of the light emitting edge to reduce light emitted in a random manner.

5. The sight claimed in claim 7 wherein said member is recessed to insertably receive said second end segment of said fiber optic.

6. The sight claimed in claim 1 wherein said base includes a platform defining openings, said light collector and conductor member including flexible lugs one each for insertion through one of said openings for biased retentive engagement with said platform.

* * * * *